US007097385B2

(12) United States Patent
Tabler

(10) Patent No.: US 7,097,385 B2
(45) Date of Patent: Aug. 29, 2006

(54) TETRAPOD CONTROL DEVICE AND METHOD FOR STABILIZING, DEPOSITING AND RETAINING WINDBLOWN PARTICLES

(76) Inventor: Ronald D. Tabler, 7505 Estate Cir., Longmont, CO (US) 80503

( * ) Notice: Subject to any disclaimer, the term of this patent is extended or adjusted under 35 U.S.C. 154(b) by 0 days.

(21) Appl. No.: 10/953,845

(22) Filed: Sep. 29, 2004

(65) Prior Publication Data

US 2006/0067790 A1 Mar. 30, 2006

(51) Int. Cl.
*E02B 3/06* (2006.01)
*E01F 7/02* (2006.01)

(52) U.S. Cl. ..... 405/29; 405/15; 405/21; 405/302.6; 405/302.7; 256/12.5

(58) Field of Classification Search ..... 405/15, 405/21, 29, 33, 302.6, 302.7; 256/12.5, 13, 256/19

See application file for complete search history.

(56) References Cited

U.S. PATENT DOCUMENTS

| | | | | |
|---|---|---|---|---|
| 361,783 | A | 4/1887 | Rudnicki | |
| 490,545 | A | 1/1893 | Dixson | |
| 1,108,943 | A | 9/1914 | Swezey | |
| 1,175,962 | A | 3/1916 | Latham | |
| 1,281,021 | A | 10/1918 | Kellner | |
| 1,281,022 | A | 10/1918 | Kellner | |
| 1,355,051 | A | 10/1920 | Kellner | |
| 1,355,052 | A * | 10/1920 | Kellner | 405/29 |
| 1,373,629 | A | 4/1921 | Nohlen | |
| 1,487,668 | A | 3/1924 | Rehfeld | |
| 1,489,647 | A | 4/1924 | Nohlen | |
| 1,523,995 | A * | 1/1925 | Naud | 256/12.5 |
| 1,541,241 | A | 6/1925 | Baxter | |
| 1,545,909 | A | 7/1925 | McKinnon | |
| 1,595,946 | A | 8/1926 | Kellner | |
| 1,627,623 | A | 5/1927 | Smith | |
| 1,635,899 | A | 7/1927 | Nohlen | |
| 1,647,585 | A * | 11/1927 | Sargent | 256/12.5 |
| 1,668,651 | A | 5/1928 | McKinnon | |
| 1,721,894 | A * | 7/1929 | Abbe | 256/23 |
| 1,819,305 | A | 8/1931 | Snyder | |

(Continued)

FOREIGN PATENT DOCUMENTS

| | | |
|---|---|---|
| DK | 61263 | 8/1943 |

(Continued)

OTHER PUBLICATIONS

Tabler, Ronald D., *Design Guidelines for the Control of Blowing and Drifting Snow*, 1994; Figs. 2.8 and 2.9, pp. 15-16; Section 3.6 Snov Deposition and Retention Due to Vegetation, pp. 58-59; and Section 5.3.9.2 The Tensar Portable Fence, pp. 219-222.

*Primary Examiner*—Jong-Suk (James) Lee
(74) *Attorney, Agent, or Firm*—John R. Ley

(57) ABSTRACT

A three-dimensional multi-pod windblown particle control device is used to control the deposition, accumulation and retention of windblown particles. The multi-pod device is formed by connecting beams to create legs which intersect one another at a crossing area. The ends of some of the legs contact the earth surface to support the device while the ends of the other legs extend in three dimensions to interact with the wind. The device may be formed by substantially identical X-shaped frame structures which intersect and connect with one another. The optimal spacing for using the devices in an array is within a range of approximately 0.5–1.5 of a transverse dimension across the surface area occupied by each particle control device.

57 Claims, 7 Drawing Sheets

U.S. PATENT DOCUMENTS

| | | | | | |
|---|---|---|---|---|---|
| 1,906,442 | A | * | 5/1933 | Barrus | 256/31 |
| 1,969,123 | A | | 8/1934 | Doble | |
| 2,032,582 | A | | 3/1936 | Lashmet | |
| 2,082,707 | A | | 6/1937 | Mahon | |
| 2,135,337 | A | | 11/1938 | Herbest, Jr. | |
| 2,248,721 | A | | 7/1941 | Rehfeld | |
| 2,263,313 | A | | 11/1941 | Rehfeld | |
| 2,306,737 | A | | 12/1942 | MacDonald | |
| 2,378,865 | A | | 6/1945 | Rehfeld | |
| 2,803,113 | A | | 8/1957 | Hoad | |
| 2,803,437 | A | | 8/1957 | Borges | |
| 2,844,005 | A | * | 7/1958 | Rehfeld | 405/29 |
| 3,218,035 | A | | 11/1965 | Dunlap | |
| 3,226,091 | A | | 12/1965 | Root | |
| 3,380,253 | A | * | 4/1968 | Vita | 405/29 |
| 3,386,250 | A | * | 6/1968 | Katayama | 405/33 |
| 3,399,535 | A | * | 9/1968 | O'Neill | 405/29 |
| 3,540,587 | A | | 11/1970 | Dawbarn | |
| 3,844,124 | A | | 10/1974 | Tupper | |
| 3,913,889 | A | | 10/1975 | Nugent et al. | |
| 3,966,172 | A | | 6/1976 | Garrett | |
| 4,335,868 | A | | 6/1982 | Ribbert | |
| 4,339,114 | A | | 7/1982 | Deike | |
| 4,388,019 | A | | 6/1983 | Kajihara | |
| 4,439,059 | A | | 3/1984 | Kikuzawa et al. | |
| 4,529,173 | A | | 7/1985 | Kramer et al. | |
| 4,549,724 | A | | 10/1985 | Taillandier | |
| 4,932,634 | A | | 6/1990 | Sura | |
| 4,947,791 | A | | 8/1990 | Laier et al. | |
| 4,954,013 | A | | 9/1990 | Lamberton | |
| 5,039,250 | A | | 8/1991 | Janz | |
| 5,123,780 | A | | 6/1992 | Martinsen | |
| 5,131,630 | A | | 7/1992 | Nash | |
| 5,184,800 | A | | 2/1993 | Tabler | |
| 5,190,403 | A | * | 3/1993 | Atkinson | 405/29 |
| 5,299,781 | A | * | 4/1994 | Barrett et al. | 256/12.5 |
| D360,476 | S | | 7/1995 | Smeja et al. | |
| 5,556,229 | A | | 9/1996 | Bishop et al. | |
| 5,901,507 | A | | 5/1999 | Smeja et al. | |
| 6,497,532 | B1 | | 12/2002 | McGinn | |
| 6,616,383 | B1 | | 9/2003 | Janz | |
| 6,824,681 | B1 | | 11/2004 | Engwer | |

FOREIGN PATENT DOCUMENTS

| | | | | |
|---|---|---|---|---|
| DK | 81858 | | 9/1956 | |
| DK | 85909 | | 10/1958 | |
| FR | 2625520 | | 7/1989 | |
| FR | 2676485 | * | 11/1992 | 256/12.5 |
| JP | 5997909 | | 6/1984 | |
| JP | 2289705 | | 11/1990 | |
| JP | 6264415 | | 9/1994 | |
| JP | 841830 | | 2/1996 | |
| JP | 8109616 | | 4/1996 | |
| JP | 8277008 | | 10/1996 | |
| JP | 11229331 | | 8/1999 | |
| SU | 629277 | | 9/1978 | |
| SU | 687164 | | 10/1979 | |

* cited by examiner

TETRAPOD CONTROL DEVICE AND METHOD FOR STABILIZING, DEPOSITING AND RETAINING WINDBLOWN PARTICLES

This invention relates to controlling windblown particles, such as snow, dust or sand. More particularly, the present invention relates to a new and improved windblown particle control device having a three-dimensional multi-pod configuration, and its effective use to control the deposition, retention and stabilization of windblown particles.

BACKGROUND OF THE INVENTION

Windblown snow, dust and sand can create hazardous driving conditions by reducing visibility and forming drifts on roadways to block or impede traffic movement. Blowing snow also causes icy roads, which are a major cause of vehicle accidents. Blowing snow can create significant problems on railroads by forming drifts that block the passage of trains where tracks pass through cuts in hills, and by clogging switches and interfering with the operation of electronic sensors for detecting over-heated journals and dragging equipment. There are many other well-known problems associated with blowing and drifting snow, dust, sand and other windblown particles.

Snow control devices in the form of snow fences and other structures have been used for many years to alleviate the problems created by blowing and drifting snow. The typical construction of a snow fence is a two-dimensional panel with a series of slots, holes or openings formed through the panel to create porosity. The snow fence creates aerodynamic drag and alters the structure of the turbulence which slows the velocity of the wind and diminishes its capacity to carry snow. In addition, a porous snow fence reduces the scale of turbulence by breaking up large eddy currents into smaller ones, thereby reducing the entrainment of particles. These effects on the wind allow the transported windblown particles to settle out and accumulate in a protected area which is sheltered by the snow fence. In the case of a porous snow fence, most of the snow deposition occurs in the protected area of the snow fence. Immediately downwind beyond the protected area is a critical area where the wind carries very little snow, because the substantial majority of the snow has been removed as the wind passes through the protected area. By positioning the snow fence far enough away from the roadway, railroad tracks or other object or area where snow accumulation is to be avoided, the snow settles out of the wind in the protected area before reaching the critical area. The wind is relatively free of snow within the critical area, so snow does not accumulate to a significant degree within the critical area which encompasses the roadway, railroad tracks or other object. Because the wind will pick up and saltate additional snow particles by blowing over expanses of snow-covered ground, the snow fence and its protected area must be close enough to encompass the roadway, railroad tracks or other object within the critical area to prevent the wind from accumulating snow again before reaching the roadway, railroad tracks or other object. Otherwise, the placement of the snow fence will be ineffective in preventing snow accumulation in the area where snow accumulation is to be avoided.

Typically, the panels of a snow fence are assembled in long continuous rows. Long rows of panels are usually necessary to achieve the best windblown particle control effects over relatively long expanses of critical areas such as roadways and railroad tracks. The panels are typically constructed of wood planks and/or steel or plastic sheeting.

Posts or triangular support frame structures anchor the panels to the ground and hold them upright to confront and withstand the forces from the wind. Because of their relative massive, complex and sturdy nature, conventional snow fences are usually built in place as permanent installations. The nature of the materials used to construct such snow fences usually makes their fabrication a time-consuming exercise. In addition to being bulky, the construction materials are usually expensive and difficult to transport to the construction site. The typical end result of constructing such snow fences is a collection of immobile, expensive and artificial structures which are visually obtrusive and aesthetically objectionable in a natural environment.

While it is theoretically possible to remove the snow fences during the seasons or parts of the year when they are not needed, and thereby avoid the objectionable environmental obtrusion during at least some parts of the year, the cost of dismantling a typical snow fence and reassembling the snow fence when or where it is needed becomes a predominant deterrent, resulting in the snow fence remaining in place on a year-around basis. The same considerations apply with respect to moving those snow fences which have not been placed in an optimal position to prevent snow from drifting and accumulating in areas where snow accumulation is not wanted. Empirical experience may be required to obtain the optimal placement of a snow fence.

The cost of dismantling a snow fence is approximately the same as the considerable cost of fabricating the snow fence in the first place. Then, the dismantled snow fence must be reconstructed, again at a further cost approximately equal to the original fabrication cost. The time required to dismantle a snow fence may be slightly less than the time required to fabricate the snow fence in the first instance, but the time requirements are considerable and significant. The relatively permanent posts and anchoring structures used to hold the snow fence panels to the ground can not be removed, even though the panels might be removed from those posts and anchoring structures.

Even ignoring the substantial expense and time required to disassemble a conventional snow fence, the relatively large amount of construction materials from which the snow fence is fabricated must be stored until the time when the snow fence is again reassembled. The amount of material and the transportation costs of those materials between the site of use and the storage location create additional problems and difficulties. The amount of space required to store the construction materials of a typical wooden panel snow fence is substantial. Use of that space for storage constitutes an additional cost associated with disassembling a snow fence, which further deters dismantling the conventional snow fence during those times when it is not needed.

Because of the negative impacts of the cost, obtrusiveness, fabrication, dismantlement, removal and storage issues described above, previous artificial snow fences and windblown particle control structures have not been used on a prevalent basis for other beneficial purposes, such as accumulating snow in agricultural fields to increase the soil moisture content for growing crops, retaining the topsoil against wind erosion, or shielding immature plants from the shear stress of wind and from the rapid evaporation of soil moisture at their critical early-growth stages. These and other potentially beneficial uses of windblown particle control devices would become more prevalent, if the costs of such control devices since its were reduced to enable their cost-effective use over large expanses of agricultural fields, if such control devices could be fabricated and dismantled conveniently and efficiently, and if such control devices could be stored efficiently when not in use. Removing such control devices from agricultural fields is essential after stable plant growth has been established to permit tending to and harvesting of the crops, among other things. Many of the same considerations are also applicable to other uses of windblown particle control devices, including keeping roadways and railroad tracks clear of snow and ice.

Apart from controlling windblown particles, various silt and sediment control devices and artificial reef structures have been devised to deposit and control silt, sediment and other waterborne particles in moving bodies of water. The fluid dynamic drag and turbulence effects necessary to control waterborne particles are considerably different from those necessary to control windblown particles. For example, fluid dynamic effects are related to the density of the medium, to the density of the transported particles, and to the square or cube of the flow velocity. The density of water is approximately 1000 times that of air and the velocity of wind is typically 10–50 times the speed of moving water. The magnitudes of difference in the fluid dynamic effects imply that waterborne particle control devices and windblown particle control devices are not readily interchangeable for performing the same tasks.

The expense and construction of silt, sediment and waterborne particle control devices also make them unsuitable for use in controlling windblown particles. Silt and sediment control devices must be constructed of relatively high strength steel members that are bolted or welded together, since such waterborne control devices must be capable of withstanding the considerable force of the higher density moving water and impacts from large objects that might be carried in the water. The structures are then reinforced and held in place by steel cables. Bolting or welding steel members together is time consuming and relatively expensive. Disassembling waterborne particle control devices is not contemplated because they are intended for continual use. Placing waterborne particle control devices in flowing rivers and along beaches is a difficult task and typically requires heavy equipment such as cranes and barges to transport and position the devices permanently in place.

Many other disadvantages and use considerations are associated with conventional snow fences and windblown and waterborne particle control devices. These disadvantages and considerations have led to the improvements of the present invention.

SUMMARY OF THE INVENTION

The present invention is directed to a multi-pod, preferably a tetrapod, windblown particle control device which is fabricated quickly from a relatively few construction materials which are inexpensive and readily available. When grouped in arrays, the control devices are capable of controlling the accumulation and retention of windblown particles as effectively and as efficiently as conventional snow fences and other windblown particle control devices which are more costly and difficult to fabricate. Furthermore, the control device may be dismantled and moved efficiently, thereby allowing the control devices to be easily repositioned to a better location for achieving optimal windblown particle control effects. For the same reasons, the control devices can be removed on a cost-effective basis during those parts of the year when they are not needed, to eliminate any visual obstruction to the natural environment during those times. When dismantled, the structural nature of the control devices allows them to be stored efficiently. The advantages of reduced cost, relative ease of construction, and efficiency in storage, permit the cost-effective use of such windblown particle control devices for other applications such as accumulating snow to increase the soil moisture content for growing crops, shielding growing crops from wind and soil moisture evaporation at their early growth stages, and retaining the topsoil against wind erosion, among other things.

These and other beneficial improvements and uses of the present invention are realized in a method of controlling deposition, accumulation and retention of windblown particles which utilizes a multi-pod windblown particle control device, a method of assembling the multi-pod windblown particle control device, and a multi-pod of windblown particle control device itself.

The method of controlling the windblown particles utilizes a multi-pod windblown particle control device having a plurality of legs which intersect one another at a crossing area which is separated from ends of the legs. The particle control device is supported from the earth surface with the crossing area spaced above the earth surface by contacting ends of some of the legs with the earth surface and extending the ends of other ones of the legs outward from the crossing area. The supported particle control device interacts with wind carrying the particles, and is positioned to locate the protected area in which the particles are deposited, accumulated and retained at a predetermined position on the earth surface so that an adjacent downwind critical area is kept relatively free of accumulating particles.

The method of assembling the multi-pod windblown particle control device comprises intersecting a plurality of legs at a crossing area, and orienting the legs to extend outward in three dimensions from the crossing area.

The multi-pod windblown particle control device comprises a first frame structure having elongated beams that cross and attach to one another at an intersection location, and a second frame structure of substantially the same configuration as the first frame structure. The first and second frame structures are connected together with at least one end of a beam of each frame structure oriented to contact the earth surface.

Other aspects of the invention involve one or more of the following features. The multi-pod control device is formed from a plurality of elongated beams which intersect one another at an intersection area to form an X-shaped frame structure, and two of the X-shaped frame structures are connected to create a three-dimensional tetrapod. The X-shaped frame structures are connected at the intersection location, or are connected by placing an upper X-shaped frame structure on top of a lower X-shaped frame structure, or are connected by interfitting a notch between two of the legs of the two X-shaped frame structures. The two X-shaped connected frame structures intersect one another approximately perpendicularly in a horizontal plane parallel to the earth surface. Offsetting the intersection location of the two elongated beams creates two relatively shorter legs and two relatively longer legs of each X-shaped frame structure which allows the ends of two shorter legs of one X-shaped frame structure and the ends of two longer legs of the other X-shaped frame structure to contact the earth surface. Interconnecting the two X-shaped frame structures allows the downward extending legs of each X-shaped frame structure to brace the other X-shaped frame structure to resist the lateral side-loading forces of the blowing wind. The intersection locations of both X-shaped frame structures are preferably aligned and commonly connected with one another, and the tetrapod is secured to the earth surface by an anchor or anchor spike which connects to each X-shaped frame structure at its intersection location.

Additional aspects of the invention involve one or more of the following features. The windblown particle control device creates the protected area upwind of an object where the accumulation of windblown particles is to be reduced, and in doing so creates an absence of windblown particles in the immediately downwind critical area which encompasses the object. The protected area may be located adjacent to a segment of a roadway so that the roadway segment is encompassed within the critical area, thereby reducing the snow and ice on the roadway segment. The protected area may be located within an agricultural field in which crops are grown, thereby increasing the soil moisture content and shielding growing plants from blowing wind. A plurality of the particle control devices are positioned in an array to increase the sizes of the protected and critical areas. The array may be formed from a plurality of rows of particle control devices, with each row being formed by plurality of aligned particle control devices. The rows and individual particle control devices in each row are spaced apart by an optimal distance within a range of approximately 0.5–1.5 of a transverse dimension across the surface area of the earth occupied by each particle control device. The particle control devices in each row are staggered longitudinally compared to the particle control devices of an adjacent row.

A more complete appreciation of the scope of the invention and the manner in which it achieves the above-noted and other beneficial effects, advantages and improvements can be obtained by reference to the following detailed description of presently preferred embodiments of the invention taken in connection with the accompanying drawings, which are briefly summarized below, and by reference to the appended claims.

DETAILED DESCRIPTION

Figure 1:
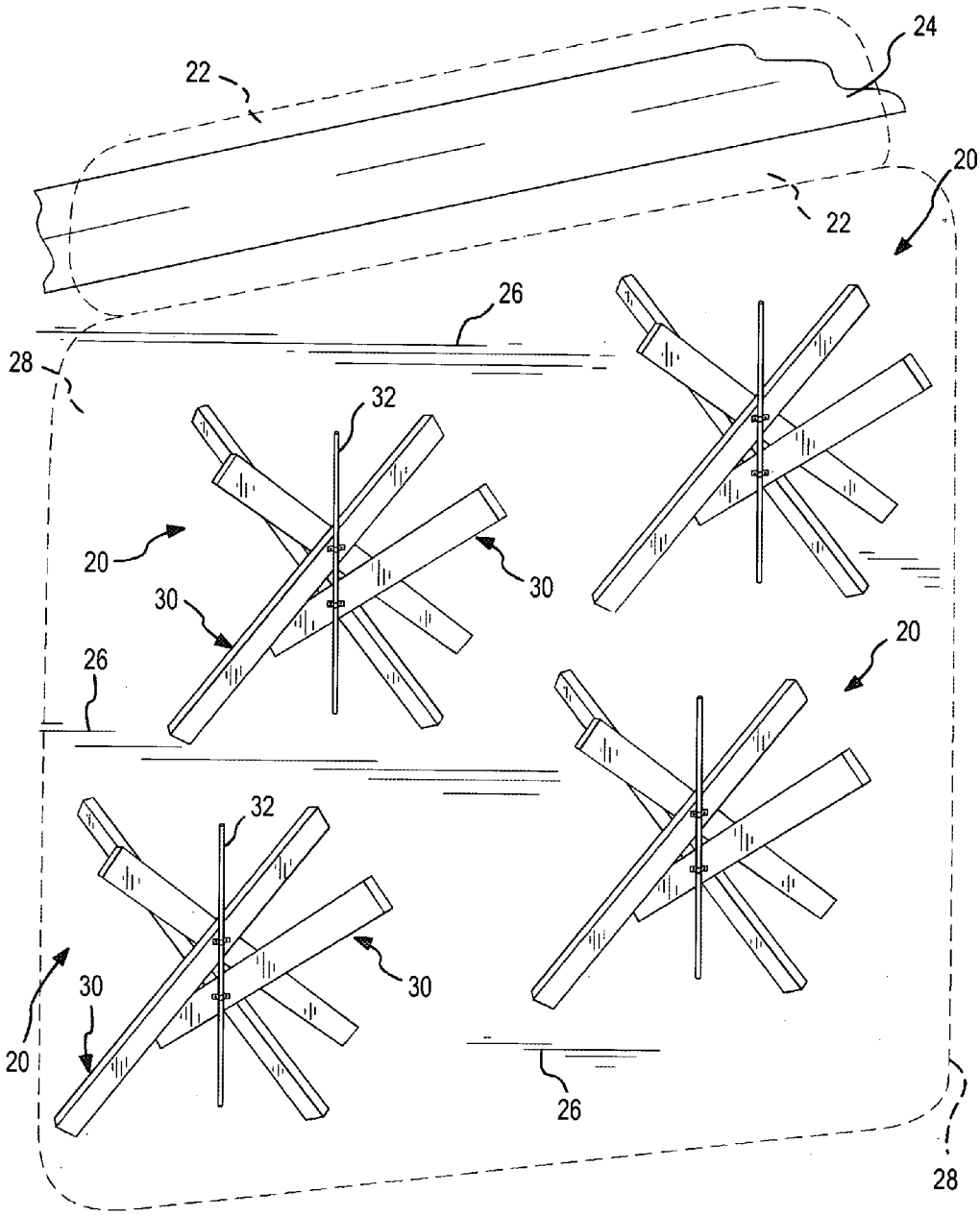
FIG. 1 is a perspective view of four tetrapod windblown particle control devices in accordance with the present invention positioned along one side of a roadway.
Figure 2:
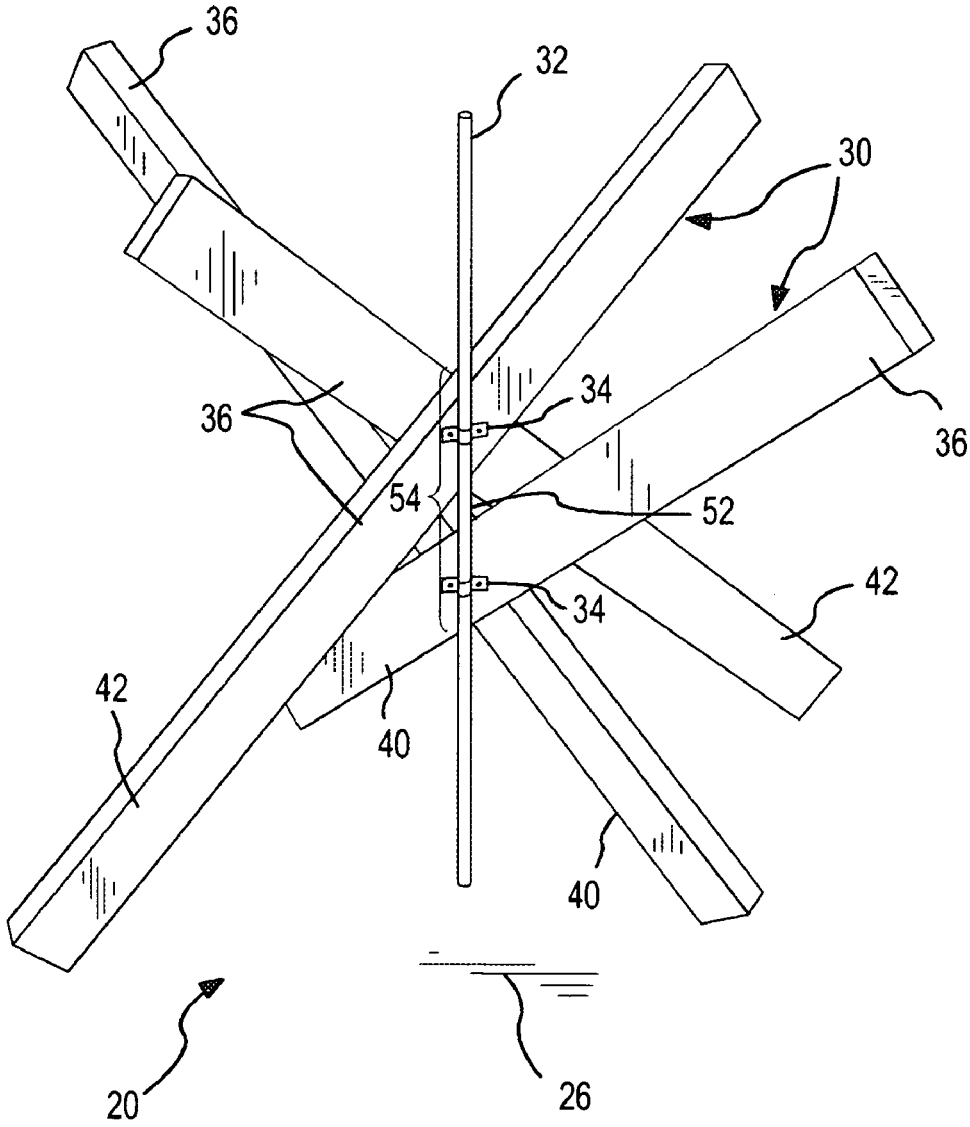
FIG. 2 is an enlarged perspective view of one of the tetrapod devices shown in FIG. 1.

The preferred form of a multi-pod windblown particle control device which incorporates the present invention is a tetrapod 20, shown in FIGS. 1–9. A plurality of tetrapods 20 are shown in FIG. 1 positioned adjacent to a critical area 22, such as a roadway 24, to prevent snow or other windblown particles from accumulating on and blowing over the roadway 24. The tetrapods 20 interact with the wind blowing horizontally over the tetrapods near the surface of the earth or ground 26, to reduce the wind velocity and to reduce the structure of the wind turbulence by breaking up large eddy currents into smaller ones. The reduced velocity and smaller-scale eddy currents cause the particles suspended in the wind to settle out of the wind and accumulate in a protected area 28 on the ground 26 which is downwind from but adjacent to the tetrapods 20. The reduced wind velocity and smaller-scale eddy currents within the protected area 28 also inhibit the wind from picking up and saltating the accumulated particles within the protected area 28, and thereby reintroducing the particles into the wind.

Figure 8:
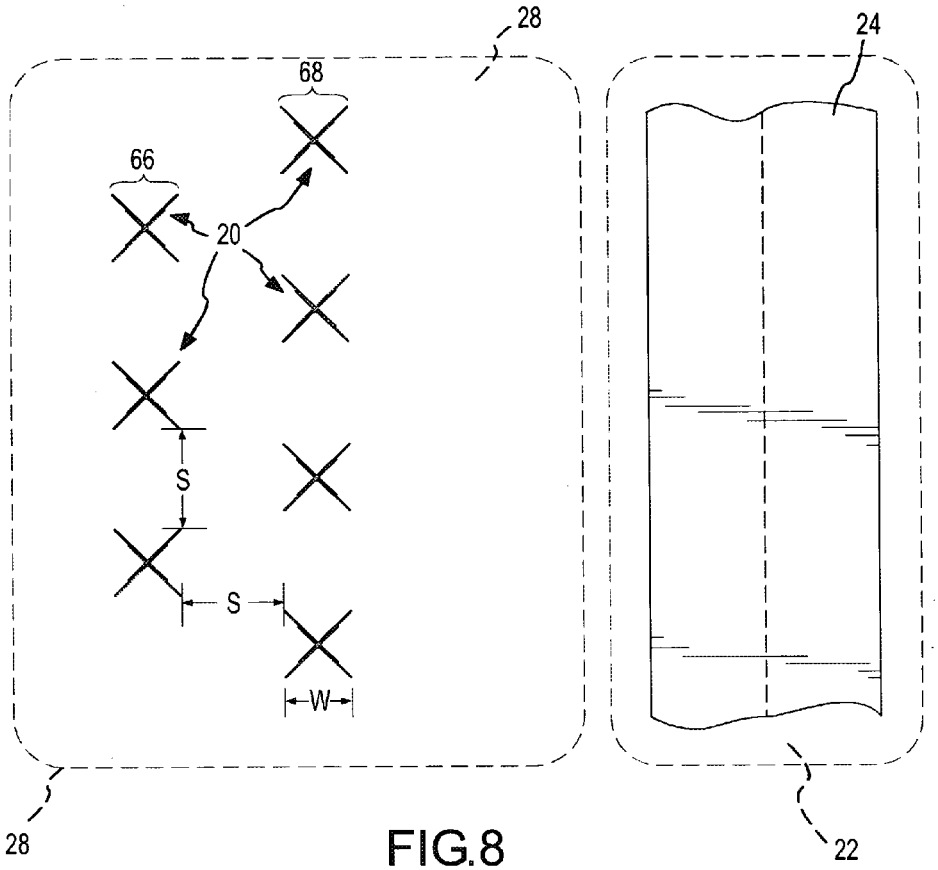
FIG. 8 is a plan view of multiple tetrapod devices positioned on one side of a roadway.
Figure 9:
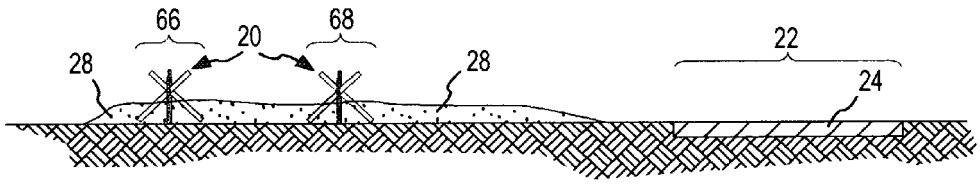
FIG. 9 is an elevation view of the tetrapod devices and the roadway shown in FIG. 8.

The critical area 22 extends downwind of and adjacent to the protected area 28. Because the windblown particles are deposited out of the wind current that flows through the protected area 28, the wind current which continues downwind from the protected area 28 and over the critical area 22 is relatively free of windblown particles. Consequently, very few if any windblown particles are available to be deposited or blown into the critical area 22. The tetrapods 20 are therefore positioned or arrayed so that the critical area 22 encompasses the roadway 24 as shown in FIGS. 1, 8 and 9, thereby significantly retarding windblown particles, usually snow, from accumulating and drifting onto the roadway 24 and from sifting continually over the roadway 24. Continually sifting snow is melted by the solar-induced thermal energy absorbed by the roadway 24, causing the snow to melt and reform has a layer of ice over the roadway 24.

The critical area 22 is sufficiently close to the protected area 28 to prevent the wind current that has blown through the array of tetrapods 20 and the protected area 28 from mixing with other wind currents which have not interacted with array of tetrapods 20. Such mixing may occur downwind of the critical area 22, but downwind mixing does not introduce windblown particles into the critical area 22. The protected area 28 encompasses the area occupied by the tetrapods 20 as well as an area that extends downwind extends downwind from the array of tetrapods 20.

Each tetrapod 20 is formed from two, substantially-identical, X-shaped frame structures 30 which have been overlapped and oriented generally perpendicularly with respect to one another in a horizontal plane, shown in FIGS. 1–7. The overlapped X-shaped frame structures 30 therefore establish three-dimensional characteristics for each tetrapod 20. The X-shaped frame structures 30 are held in the overlapped configuration and in a position extending vertically upward from the ground 26 by interaction with one another and by an anchor spike 32. The anchor spike 32 extends through anchor brackets 34 that are attached to both X-shaped frame structures 30. The anchor spike 32 extends into the ground 26 a sufficient distance to anchor both X-shaped frame structures 30 to the ground 26 and to resist significant tipping and skidding movement of the X-shaped frame structures 30 in reaction to loads from the blowing wind.

Figure 4:
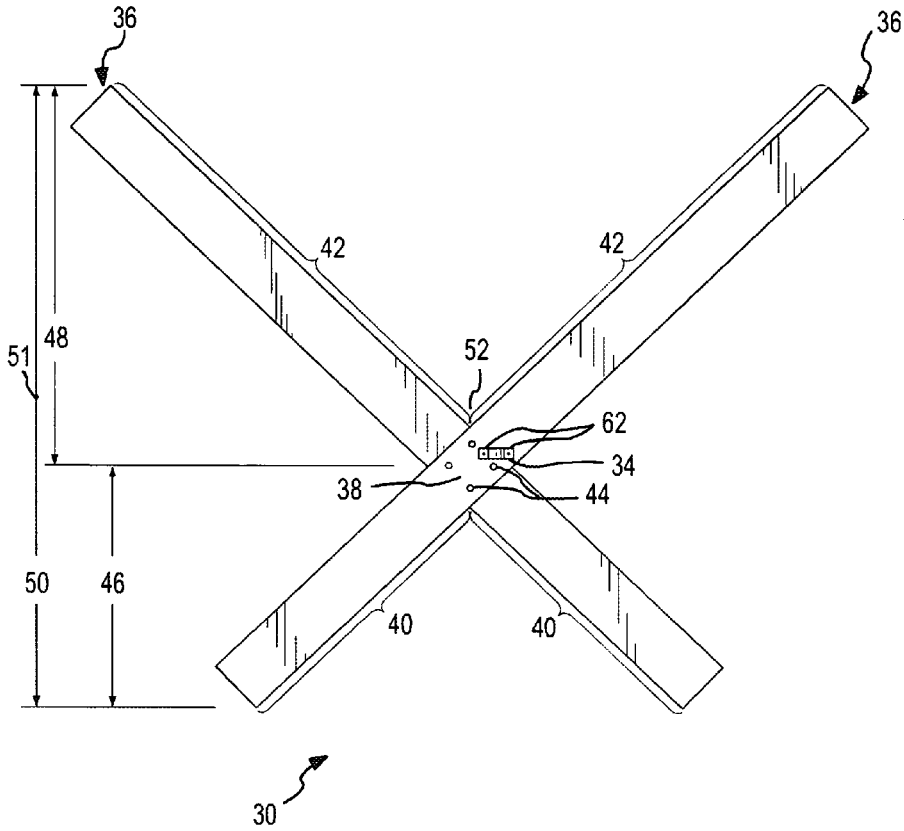
FIG. 4 is an elevational view of one of two X-shaped frame members used to fabricate the tetrapod devices shown in FIGS. 1–3.

Each X-shaped frame structure 30 is formed by connecting two substantially equal length beams 36 at an intersection location 38, as shown principally in FIG. 4. The intersection location 38 is an unequal distance from the opposite ends of each of the equal-length beams 36, thereby creating each X-shaped frame structure 30 with two relatively shorter legs 40 and two relatively longer legs 42. The lengths of the legs 40 and 42 are measured from the intersection location 38 to the ends of each of the beams 36. Since the intersection location 38 is at approximately the same position along the length of both beams 36, the lengths of the shorter legs 40 are generally equal and the lengths of the longer legs 42 are also generally equal. The two beams 36 are held together at the intersection location 38 by fasteners, such as screws 44.

Because of the equal and relatively shorter lengths of the legs 40 compared to the equal and relatively longer lengths of the legs 42, the intersection location 38 is spaced a lesser vertical distance 46 from the ends of the shorter legs 40 compared to the greater vertical distance 48 from the ends of the longer legs 42. The intersection location 38 is therefore offset from a midpoint of a total vertical height or distance 50 between the ends of the beams 36 which form each X-shaped frame structure 30. The total vertical height of each X-shaped frame structure is that distance 50 between two parallel lines that extend through the ends of the beams 36 of the shorter and longer legs 40 and 42, respectively. The sum of the lesser vertical distance 46 and the greater vertical distance 48 equals the total vertical height 50. The intersection location 38 of each X-shaped frame structure 30 is vertically offset toward the shorter legs 40 and away from the longer legs 42, measured from a midpoint 51 of the total vertical height 50 of each X-shaped frame structure.

Figure 3:
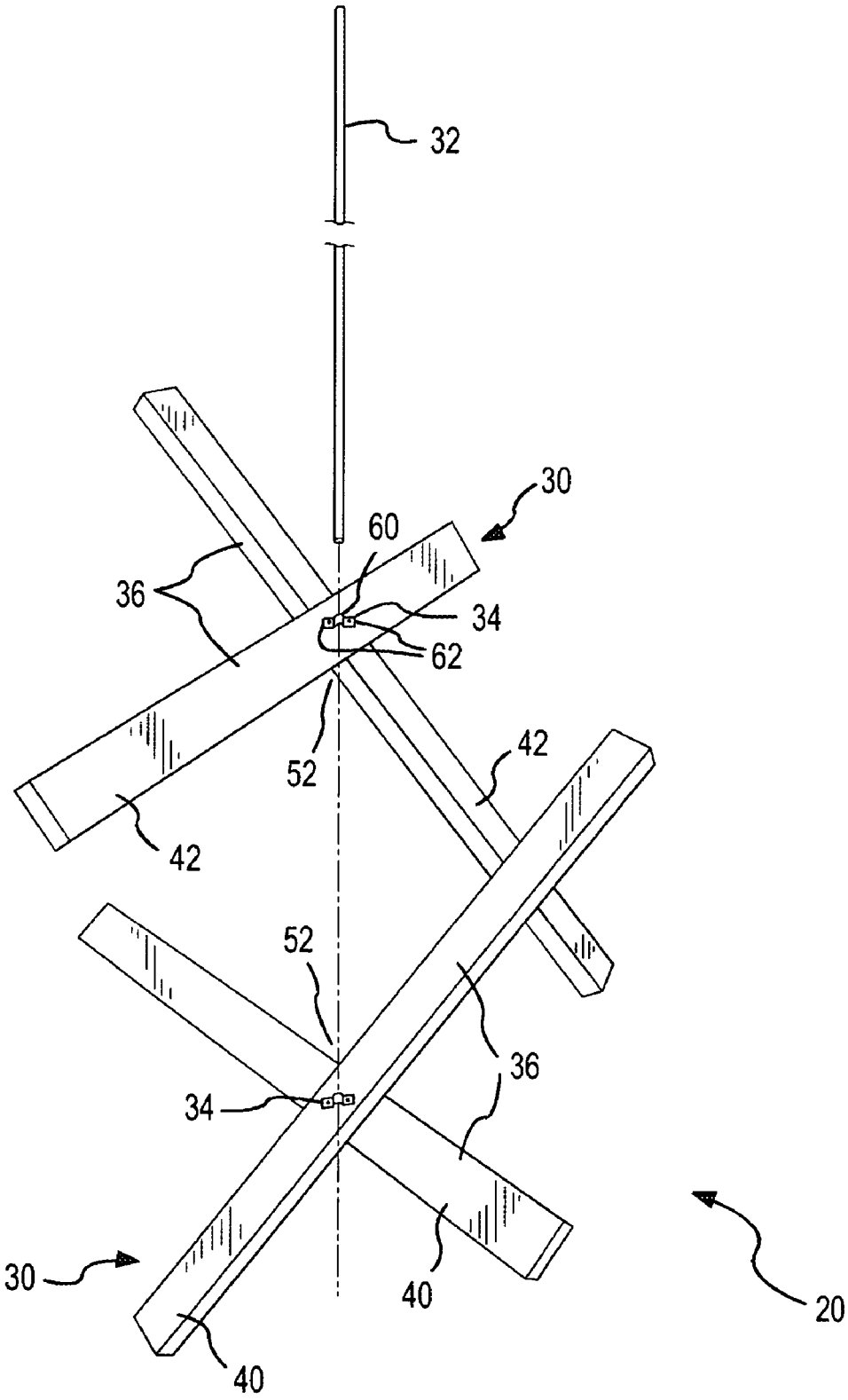
FIG. 3 is a vertically exploded view of the tetrapod shown in FIG. 2.
Figure 5:
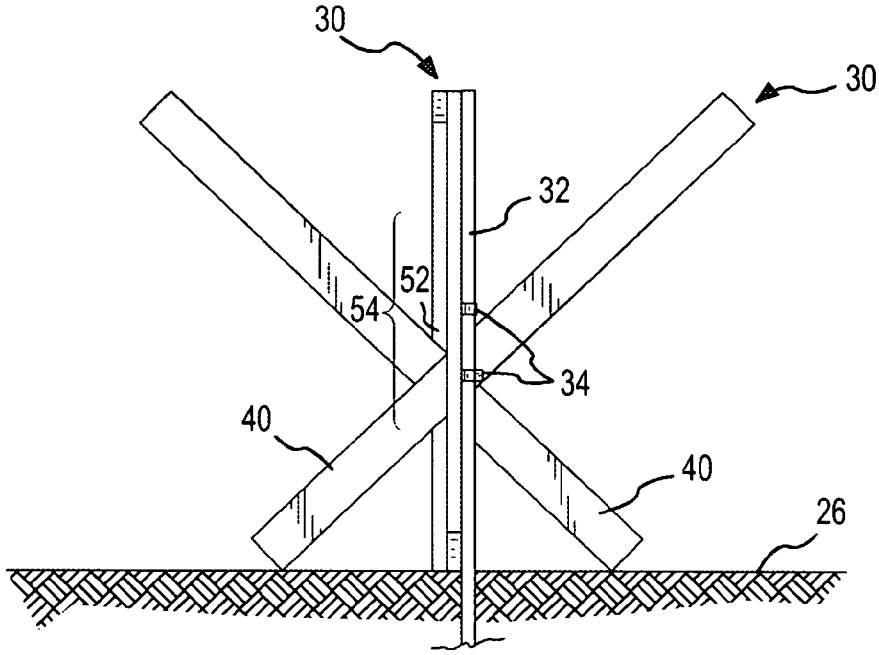
FIG. 5 is one side elevation view of the tetrapod device shown in FIG. 2.
Figure 6:
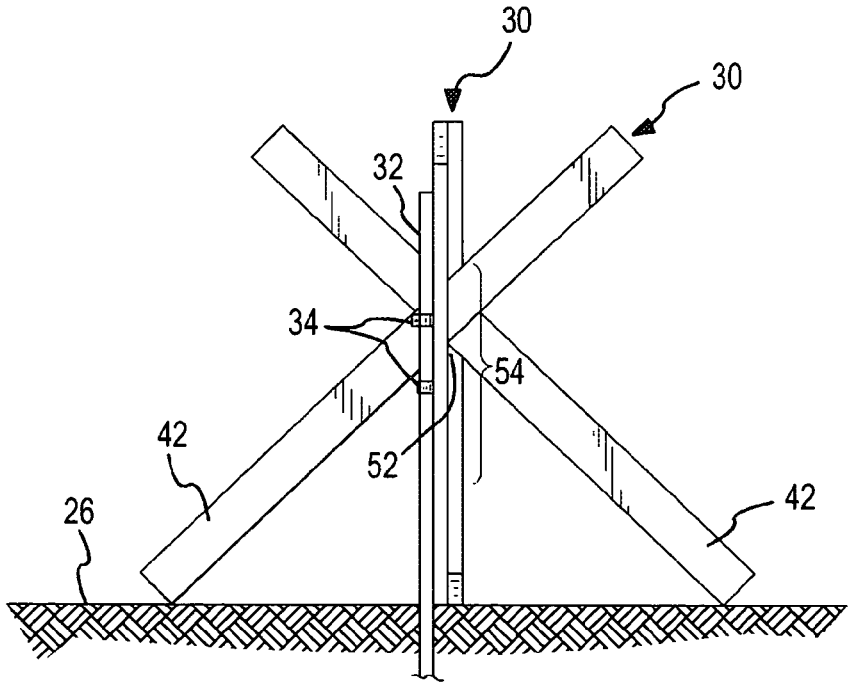
FIG. 6 is another side elevation view of the tetrapod device shown in FIG. 2, rotated 90 degrees about a vertical reference with respect to FIG. 5.

The vertical offsets of the intersection locations 38 of the two X-shaped frame structures 30 are useful in establishing the overlapped relationship of the two X-shaped frame structures 30 in the tetrapod 20, as understood from FIGS. 3, 5 and 6. To form the tetrapod 20, a first one of the X-shaped frame structures 30 is positioned with the ends of the shorter legs 40 contacting the ground 26. In this position, the intersection of location 38 of the first frame structure is offset toward the ground 26, and a notch 52 (FIG. 4) formed by the intersection of the longer legs 42 at the intersection location 38 faces upward. Thereafter, the second one of the X-shaped frame structures 30 is overlapped on top of the first frame structure 30, with the longer legs 42 of the second frame structure 30 contacting the ground 26. The intersection location 38 of the second frame structure is offset away from the ground 26, and its notch 52 faces downward. The two overlapped X-shaped frame structures 30 intersect one another perpendicularly in a horizontal plane (FIG. 7), with the notches 52 of both X-shaped frame structures fitting together (FIG. 3).

In the described overlapped relationship, the intersection locations 38 of both frame structures are vertically offset from one another and are vertically aligned with respect to one another. Consequently, the single anchor spike 32 is able to extend vertically through both anchor brackets 34 attached to the intersection locations 38 of both overlapping frame structures 30. Offsetting the intersection locations 38 assures that the ends of all four beams of both X-shaped frame structures 30 will contact the ground 26, thereby creating stability for the tetrapod 20. Offsetting the intersection locations 38 also causes both X-shaped frame structures 30 to interlock with one another and mutually brace each X-shaped frame structure 30 in a position extending generally vertically with respect to the ground 26.

The interlocking relationship is established by the contact of both sets of longer legs 42 at V-shaped notches 52 (FIG. 4) of each X-shaped frame structure 30. One V-shaped notch 52 is created in each X-shaped frame structure 30 at the extension of the longer legs 42 from the intersection location 38. The upward facing V-shaped notch 52 of the lower X-shaped frame structure 30 receives the overlapping portions of the beams 36 at the intersection location 38 of the upper X-shaped frame structure. Similarly, the downward facing V-shaped notch 52 of the upper X-shaped frame structure 30 receives the overlapping portions of the beams 36 at the intersection location 38 of the lower X-shaped frame structure. Positioning the intersection location 38 of one X-shaped frame structure within the V-shaped notch 52 of the other frame structure creates the interlocking relationship.

The mutual bracing relationship is established by the legs of each X-shaped frame structure 30 which contact the ground 26 and extend to the interlocked intersection locations 38. The shorter legs 40 of the lower X-shaped frame structure 30 brace the upper X-shaped frame structure relative to the ground 26 by force transfer through the interfitting notches 52 (FIG. 5) and the anchor spike 32 extending through the anchor brackets 34. Similarly, the longer legs 42 of the upper X-shaped frame structure brace the lower X-shaped frame structure relative to the ground 26 by force transfer through the interfitting notches 52 (FIG. 6) and the anchor spike 32 extending through the anchor brackets 34.

The interlocking and mutual bracing relationship holds both X-shaped frame structures oriented vertically and generally perpendicular to the ground 26 in the tetrapod 20. Each X-shaped frame structure 30 resists side-loading forces on the other X-shaped frame structure 30. The interlocking and mutual bracing relationship can only be defeated if one of the X-shaped frame structures 30 is vertically separated from the other frame structure 30. Vertically separating the two X-shaped frame structures 30 will separate the interfitting V-shaped notches 52 from one another, and thereby release the interconnected relationship of the two frame structures 30. It is unlikely that a normal and anticipated range of wind on the X-shaped frame structures 30 will vertically lift the upper X-shaped frame structure 30 off of the lower X-shaped frame structure, because the normal and anticipated velocity of the wind is not capable of inducing sufficient upward force to overcome the weight of the upper X-shaped frame structure. The lower X-shaped frame structure is unlikely to sink into the ground 26 while the upper X-shaped frame structure remains stationary, because the lower ends of the beams 36 of both intersecting X-shaped frame structures contact essentially the same area of ground 26 and should be subject to the same resistance from the ground. Both X-shaped frame structures are likely to move approximately the same amount with any movement of the ground 26, and in doing so will maintain the interlocking and mutually bracing relationship.

Offsetting the intersection locations 38 of the two overlapped X-shaped frame structures 30 establishes a general common crossing location or area 54 for each tetrapod 20 (FIGS. 2, 5 and 6) at which the X-shaped frame structures 30 are interconnected. The crossing area 54 is somewhat greater than twice the vertical height of the intersection location 38 of each X-shaped frame structure 30 (FIG. 4). The anchor spike 32 is connected by the anchor brackets 34 to both X-shaped frame structures 30 of the tetrapod 20 within the crossing area 54. With respect to the tetrapod 20 as a whole, the crossing area 54 is generally approximately equal in distance from the four ends of the beams 36 which contact the ground 26 and from the four ends of the beams 36 which are located above the ground 26. By connecting the anchor spike 32 to the common crossing area 54 at approximately the midpoint of the vertical height 50 (FIG. 7) of each tetrapod 20, the best resistance is achieved to withstand a combination of tilting and sliding movement forces imposed from side loads due to the horizontally blowing wind.

The amount of offset of each intersection location 38 compared to the overall height of each X-shaped frame structure 30 depends on the angle at which the beams 36 intersect one another. A lesser acute angle of intersection will require a greater degree of offset, in order to align the intersection locations 38 of the two overlapped X-shaped frame structures 30 with one another at the crossing area 54. Preferably, the two beams 36 of each X-shaped frame structure 30 intersect one another approximately perpendicularly.

Figure 7:
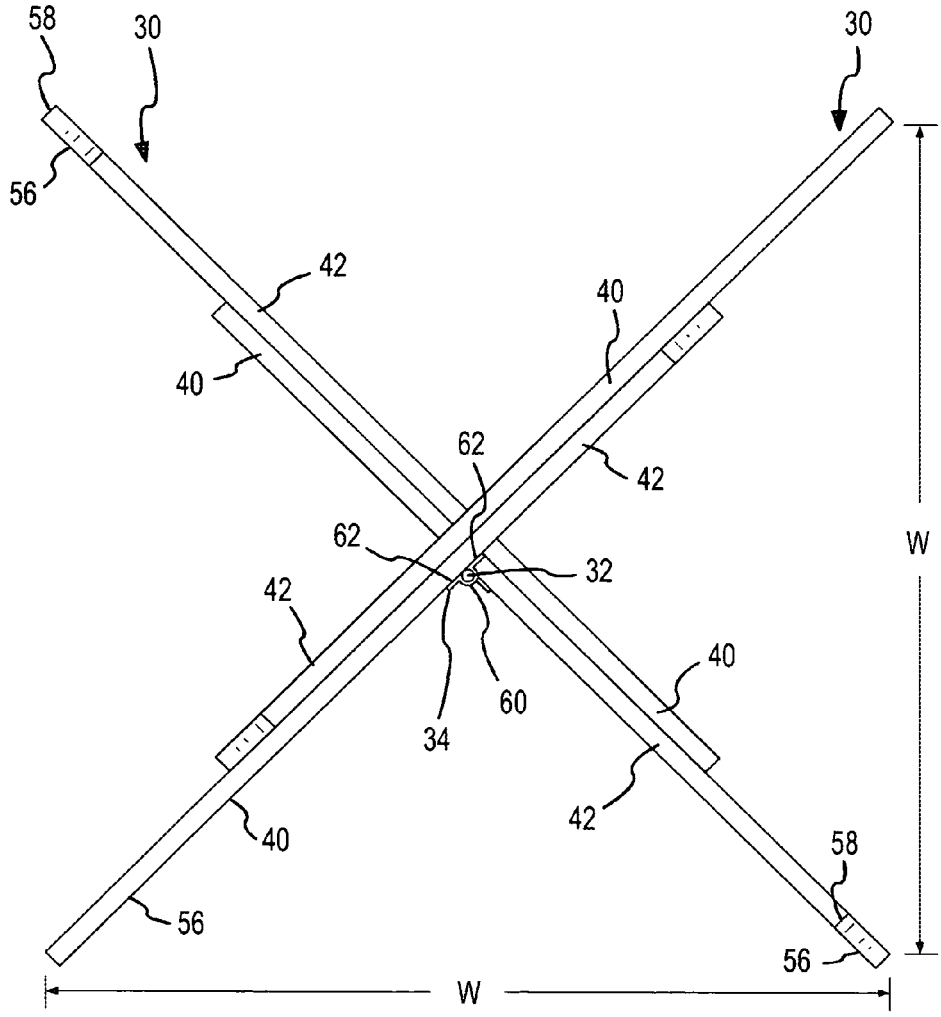
FIG. 7 is a top plan view of the tetrapod device shown in FIG. 2.

The elongated beams 36 are sufficiently rigid to withstand the force of the wind without twisting or wobbling in the wind, in order to aerodynamically reduce the wind velocity and create the smaller eddy currents. The aerodynamic effects are enhanced when each beam 36 is generally rectangular in cross-section, having a relatively broad side 56 and a relatively narrow side 58 (FIG. 7). The relatively broad sides 56 are oriented vertically, and the broad sides 56 contact one another at the intersection location 38. The horizontally facing broad sides 56 create greater aerodynamic effects on the horizontally blowing wind than if the narrow sides 58 faced the horizontally blowing wind. The four beams 36 of each tetrapod 20 extend in different directions with respect to one another which enables the tetrapod 20 to aerodynamically influence wind blowing from any direction.

The beams 36 are preferably made from lengths of pressure-treated lumber, or plastic or other composite synthetic materials which has been treated or otherwise constructed to withstand and resist resisting natural influences under conditions of prolonged exposure to the natural environment. Each of the beams 36 may be a conventional two inch by four inch piece of construction lumber. The entire length of each beam 36 may be in the neighborhood of approximately four feet. The length of each beam 36 establishes the height of each tetrapod 20, and the height of each tetrapod 20 is selected to accommodate an anticipated amount of windblown particles or snow which are to be controlled. A slight scouring effect on the accumulated particles at points within the protected area 28 may occur when the level of snow accumulated in the protected area 28 is below the crossing area 54. No such scouring effect has been noted when the snow accumulates to a level equal to or greater than the height of crossing area 54. Accordingly, the height of the tetrapods 20 should not be so great as to continually extend the crossing area 54 and the upper portions of the tetrapods 20 outside of the accumulated snow. The scouring effect under relatively low snow accumulations is counteracted by natural vegetation on the ground 26, so locating the crossing area 54 a modest distance above the ground does not adversely affect the snow accumulation and retention characteristics of the tetrapod in a substantial manner. Lengths of the beams 36 in the neighborhood of approximately four feet are generally considered suitable for most snow control applications along roadways.

Each anchor bracket 34 is attached to the broader side 56 of one beam 36 at the intersection location 38 of each X-shaped frame structure 30. The anchor bracket 34 includes a center semicircular loop section 60 from which two generally flat attachment tab sections 62 extend outwardly on opposite sides of the center loop section 60 (FIGS. 3 and 7). The anchor bracket 34 is attached to the beam 36 by extending fasteners, such as screws (not shown), through the tab sections 62 at the intersection location 38. The tab sections 62 extend generally horizontal to the terminal ends of the intersecting beams 36 which form each X-shaped frame structure 30 (FIG. 4). With the anchor bracket 34 attached, the loop section 60 curves away from the broader side 56 of the beam 36 to create a vertical passageway between the loop section 60 and the broad side 56 of the beam 36 in which to receive the anchor spike 32. The vertical passageways of the two anchor brackets 34 align with one another to receive the anchor spike 32 when the two X-shaped frame structures 30 are interconnected with one another.

The anchor spike 32 is preferably a round steel rod, such as conventional concrete reinforcing bar. The anchor spike 32 extends through the two vertically aligned anchor brackets 34 in the common crossing area 54 and is driven into the ground 26. The length of the anchor spike 32 is sufficient to extend into the ground 26 enough distance to hold the two X-shaped frame structures 30 vertically upright and to resist tilting and horizontal skidding movement of the tetrapods in response to wind loading and to resist lifting the X-shaped frame structures 30 off of the ground 26.

While each of the tetrapods 20 is capable of causing windblown particles to settle out of the wind in its own individualized protected area and to create its own individual critical area, the best use of the tetrapods 20 is in an array in which the individualized protected areas from the array of tetrapods overlap and combine with one another to create a unified, larger, common protected area 28 and a unified, larger, common critical area 22 (FIG. 1). Causing the individualized protected areas from each tetrapod to overlap and aggregate is caused by spacing the tetrapods 20 at a predetermined spacing distance S relative to one another in an array.

The array of tetrapods 20 is preferably established by parallel lines of tetrapods, with each line extending generally perpendicular to the prevailing wind direction. The relative spacing between the tetrapods in each parallel line, and the spacing between the parallel lines of the tetrapods is defined with respect to a width dimension W of each tetrapod, as is understood from FIG. 7. The width dimension W is the horizontal dimension of a planar area or footprint on the ground 26 encompassed by a tetrapod 20. In general, the width dimension W of a tetrapod 20 will be the horizontal distance between the end of one longer leg 42 and an end of another adjacent longer leg 42, recognizing that the end of one adjacent longer leg will be in contact with the ground 26 and the end of the other adjacent longer leg will be located in the air. The width dimension W is illustrated in FIG. 7.

When used in an array, the spacing distance S between adjacent tetrapods 20 and each row is preferably in the range of approximately 1.0–1.5 times the width dimension W, with the preferred spacing distance S being approximately 1.5 W, depending on the slope of the terrain. Making the spacing distance S less than 1.0 W will result in greater snow depth accumulation within the protected area 28, but the protected area 28 is smaller in size for a fixed number of tetrapods. In other words, the fixed number of tetrapods at the lesser spacing create a smaller protected area. More tetrapods at the lesser spacing are required to increase the size of the protected area, but the added tetrapods increase the cost of establishing a specific size of a critical area 22. A larger protected area is achieved by spacing the tetrapods at the preferred spacing of approximately 1.0 W–1.5 W, but the depth of snow accumulated in the larger protected area will be somewhat less. Overall, there is a balance between deposition depth and the area of coverage. While a more dense or more closely spaced array of tetrapods may accumulate more snow depth, the total volume of snow may be larger for a specified number of tetrapods with the spacing S=1.0–1.5 W. Separating the tetrapods 20 at the spacing distance S=1.0–1.5 W provides the most effective windblown particle control by using the minimal number of tetrapods 20.

A spacing which is substantially greater than 1.5 W permits a wake turbulence effect downstream of the individual tetrapods, and that effect seems to create somewhat individualized protected areas 28 behind the last row of tetrapods in the downstream portion of the protected area 28, rather a common protected area for all of the tetrapods in the entire array. A multiplicity of individualized protected areas 28 will accumulate and retain less total snow compared to the greater aggregate accumulation and retention effects of the single larger common protected area. The single larger protected area exists when the spacing distance S is equal to or less than approximately 1.5 W. Spacing the tetrapods in the beneficial manner described is illustrated in FIGS. 8 and 9.

An array of tetrapods 20 is shown in FIGS. 8 and 9 positioned adjacent to the roadway 24, to accumulate and retain snow in the protected area 28 and to encompass the roadway 24 within the critical area 22. The relative lack of snow in the wind within the critical area 22 keeps the roadway 24 clear of accumulated snow and prevents the snow from sifting over the roadway 24 where it melts from solar induced thermal energy and then freezes into ice. The array of tetrapods 20 is therefore used to keep the roadway 24 relatively clear and relatively free of ice.

The array of tetrapods 20 must also be far enough away from the roadway 24 to prevent the protected area 28 from encompassing the roadway 24. Positioning the array of tetrapods 20 too close to the roadway 24 causes the accumulated snow in the protected area 28 to engulf the roadway 24. Positioning the array of tetrapods 20 too far from the roadway 24 separates the critical area 22 from the roadway 24 and allows the wind to re-accumulate snow and carry the snow onto the roadway 24.

The array of tetrapods 20 is formed by multiple rows of tetrapods, with the rows each extending generally perpendicular to the prevailing wind direction. In the example shown in FIGS. 8 and 9, the prevailing wind direction is from left to right at an angle which is essentially perpendicular to the roadway 24. Two rows 66 and 68 of tetrapods 20 are arranged parallel to the roadway 24 and parallel to one another. The tetrapods 20 in each row 66 and 68 are spaced apart by the spacing distance S. As discussed above, the spacing distance is preferably within the range of 0.5–1.5 times the width distance W of the footprint of each tetrapod W. The two rows 66 and 68 are separated by the spacing distance S.

The tetrapods 20 in one row are staggered or offset a direction parallel to the row with respect to the tetrapods in the adjacent row, so that each tetrapod in one row is positioned in the middle of the space between adjacent tetrapods in the other row, as shown. Staggering the tetrapods 20 in one row with respect to the tetrapods in an adjacent row assures that the individualized protected areas created by each of the tetrapods 20 overlap and aggregate to create a unified common protected area 28 for the entire array of tetrapods 20. Staggering the tetrapods also accommodates a relatively wide range of wind direction angles relative to the prevailing wind direction, while still establishing an effective and unified common protected area 28 for the entire array of tetrapods. Since the wind direction changes from time to time, staggering of the tetrapods in the parallel rows assures that the tetrapods confront the wind to achieve effective windblown particle or snow deposition and retention in the combined protected area 28 and assures that the critical area 22 does not encompass the roadway 24 even under changed wind directions.

The number of tetrapods 20 in each row of the array depends on the length of the critical area or segment of the roadway 24. The number of parallel rows of tetrapods depends on the typical amount of snow that must commonly be deposited, maintained and controlled along the critical area or section of roadway 24, which in turn is related to the size of the protected area 28 which must be created so as to establish an adequate size for the critical area 24 to encompass the roadway 24. The spacing between individual tetrapods in each row will typically be uniform, although uniform spacing is not required. Similarly, the spacing between individual rows may or may not be uniform. The slope of the ground 26 upon which the array of tetrapods is positioned may also dictate differences in spacing. The tetrapods have maximum accumulation and retention capability when placed on flat ground, as opposed to surfaces sloping upward in the direction of the wind. Greater accumulation and retention of snow on sloped surfaces may be accommodated by reducing the spacing distance S between the rows of tetrapods and the tetrapods in the rows. The spacing distance S has been determined for tetrapods four foot long beams 36 of two inch by four-inch construction lumber. Other constructions may require adjustments in the spacing distance S. Furthermore, the rows of tetrapods can be curved as well as linear, and the length of each row of tetrapods need not extend the full length of the protected area 28 and critical area 22. Instead, rows of partial length may be initiated and terminated as desired within the larger array of tetrapods. In general, the optimal aspects for any particular array of tetrapods may be understood through empirical experience.

The tetrapods 20 are easily changed in position within the array, to achieve better windblown particle control effects. The anchor spike 32 is removed from the ground 26, and the upper X-shaped frame structure 30 is lifted off of the lower X-shaped frame structure. The two X-shaped frame structures are moved to the new location, interlocked with one another by placing the upper X-shaped frame structure over the lower frame structure, and the anchor spike 32 is inserted through the vertically aligned anchor brackets 34 and into the ground 26. The tetrapods 20 are therefore conveniently and relatively inexpensively moved to obtain better particle control effects. This is a significant advantage over more traditional types of snow fences which are very difficult and expensive to move as well as to fabricate.

The tetrapods 20 are also constructed of relatively inexpensive and common materials. The X-shaped frame structures are constructed quickly using basic assembly skills. Once constructed, the X-shaped frame structures 30 are light enough in weight so that they can be transported to the location where the tetrapods are to be erected, and then positioned in the interlocking relationship and retained with the anchor spikes 32 to form the tetrapods 20. The construction of the X-shaped frame structures 30 may also be performed at the site where the tetrapods are to be erected and used.

The tetrapods may also be easily taken down during those parts of the year when they are not needed. Since the X-shaped frame structures 30 are substantially two-dimensional, the frame structures 30 can be stored by stacking them one on top of another to conserve space in storage areas and on vehicles when transporting the frame structures 30 to and from the site of use. The reduced costs of storing and transporting the X-shaped frame structures 30 improve the economies of removing the tetrapods when they are not needed.

The tetrapods can be used for other beneficial purposes for which windblown particle control devices have not previously been used on a prevalent basis. For example, the relatively low cost of fabrication and the relative ease of taking down the tetrapods also permits them to be placed in agricultural fields to accumulate snow and increase soil moisture content for growing crops, to retain the topsoil against wind erosion, and to shield immature plants from wind shear stress and rapid evaporation of soil moisture at their critical early-growth stages. These uses in agricultural fields become beneficial because of the favorable economics associated with rapidly and effectively erecting and dismantling the tetrapods. The ability to remove the tetrapods from the agricultural fields during other stages of crop growth is necessary to tend to and harvest the crops.

As noted above, the tetrapods 20 are the preferred form of a multi-pod of windblown particle control device. Multi-pod devices of similar effectiveness in controlling the accumulation and retention of windblown particles such as snow can also be constructed using more are less than the four legs which contact the ground 26. For example, three legged devices can be constructed by intersecting three beams relative to one another and joining them at a common crossing area. Five or more beams can also be used in an intersecting relationship similar to the overall organization of a teepee frame. Other types of multi-pod particle control devices may also be fabricated in accordance with the broad scope of the invention. The spacing distance S and the footprint dimension W for the other types of multi-potted windblown control devices may be different than those described above, and should be determined through empirical experience with such multi-pod devices.

Many other substantial advantages and improvements will be apparent upon fully understanding the significance and aspects of the present invention. The presently preferred tetrapod embodiment of the invention and many of its improvements and benefits have been described with a degree of particularity. This description is of the preferred example of implementing the invention, and is not necessarily intended to limit the scope of the invention. The scope of the invention is defined by the following claims.

The invention claimed is:

1. A method of controlling deposition, accumulation and retention of windblown particles within a protected area on the earth surface to reduce substantially the number of windblown particles carried by wind within a critical area which is adjacent to and downwind of the protected area on the earth surface, comprising:

utilizing a multi-pod windblown particle control device comprising a plurality of legs which intersect one another at a crossing area which is separated from ends of the legs;

supporting the particle control device from the earth surface with the crossing area spaced above the earth surface by contacting ends of some of the legs with the earth surface and extending the ends of other ones of the legs outward from the crossing area in three dimensions above the earth surface and within the wind;

interacting the supported particle control device with wind carrying the particles to deposit, accumulate and retain a substantial majority of the particles in the protected area; and positioning the supported particle control device to locate the protected area at a predetermined position on the earth surface.

2. A method defined by claim 1, further comprising:

securing the particle control device to the earth surface.

3. A method defined by claim 2, further comprising:

securing the particle control device with an anchor extending into the earth.

4. A method as defined in claim 1, further comprising:

locating the predetermined position of the protected area upwind of an object at which the accumulation of windblown particles is to be substantially reduced; and locating the predetermined position of the protected area to establish the critical area at a location which encompasses the object.

5. A method as defined in claim 4, further comprising:

locating the predetermined position of the protected area adjacent to a segment of a roadway; and encompassing the segment of the roadway with the critical area.

6. A method as defined in claim 5, further comprising:

positioning a plurality of supported particle control devices in an array upwind of the segment of roadway.

7. A method as defined in claim 1, further comprising:

locating the predetermined position of the protected area within a location where the accumulation of windblown particles is to be substantially increased.

8. A method as defined in claim 7, further comprising:

locating the predetermined position of the protected area within an agricultural field in which crops or forage are grown.

9. A method as defined in claim 8, further comprising:

positioning a plurality of supported particle control devices in an array within the agricultural field.

10. A method as defined in claim 1, further comprising:

positioning a plurality of supported particle control devices in an array.

11. A method as defined in claim 10, further comprising:

forming the array as a row of the particle control devices; and forming the row by a plurality of the particle control devices.

12. A method as defined in claim 11, further comprising:

spacing each of the particle control devices in the row apart from one another by a predetermined device spacing distance.

13. A method as defined in claim 12, further comprising:

establishing the predetermined device spacing distance in relation to a size of a surface area of the earth occupied by each supported particle control device.

14. A method as defined in claim 13, further comprising:

establishing the predetermined device spacing distance within a range of approximately 0.5–1.5 of a transverse dimension across the surface area of the earth occupied by each supported control device.

15. A method as defined in claim 12, further comprising:

forming the array by a plurality of the rows which extend generally parallel to one another; and spacing each of the parallel rows of the particle control devices apart from one another by a predetermined row spacing distance.

16. A method as defined in claim 15, further comprising:

establishing the predetermined row spacing distance as approximately equal to the predetermined device spacing distance.

17. A method as defined in claim 15, further comprising:
establishing the predetermined device spacing distance and the predetermined row spacing distance each within a range of approximately 0.5–1.5 of a transverse dimension across the surface area of the earth occupied by each supported control device.

18. A method as defined in claim 15, further comprising:
staggering the position of each particle control device in each row relative to a longitudinal position of the particle control devices in an adjacent row.

19. A method as defined in claim 1, further comprising:
forming the multi-pod windblown particle control device with a plurality of elongated beams which intersect one another at the crossing area, at least some of the intersecting beams forming two legs which extend in opposite directions from the crossing area.

20. A method as defined in claim 1, further comprising:
forming the multi-pod windblown particle control device as a tetrapod.

21. A method as defined in claim 20, further comprising:
forming each tetrapod from two intersecting X-shaped frame structures.

22. A method as defined in claim 21, further comprising:
utilizing X-shaped frame structures which are formed by two elongated beams which intersect one another at an intersection location to create the legs as portions of each elongated beams which extend from the intersection location; and
connecting the two X-shaped frame structures together to extend the legs in three dimensions.

23. A method as defined in claim 22, further comprising:
interlocking the two X-shaped frame structures by placing an upper X-shaped frame structure on top of a lower X-shaped frame structure.

24. A method as defined in claim 22, further comprising:
interfitting a notch between two upward extending legs of the lower X-shaped frame structure and a notch between two downward extending legs of the upper X-shaped frame structure.

25. A method as defined in claim 22, further comprising:
connecting the two X-shaped frame structures by intersecting the two X-shaped frame structures with one another approximately perpendicularly in a horizontal plane parallel to the earth surface.

26. A method as defined in claim 22, further comprising:
offsetting the intersection location of the two elongated beams to create two relatively shorter legs and two relatively longer legs of each X-shaped frame structure;
contacting ends of the two shorter legs of one X-shaped frame structure with the earth surface; and
contacting ends of the two longer legs of the other X-shaped frame structure with the earth surface.

27. A method as defined in claim 26, further comprising:
placing the other X-shaped frame structure on top of the one X-shaped frame structure with notches between the longer legs of both X-shaped frame structures interfitting with one another.

28. A method as defined in claim 26, further comprising:
vertically aligning the intersection locations of both X-shaped frame structures with respect to one another.

29. A method defined by claim 28, further comprising:
commonly connecting the vertically aligned intersection locations of both X-shaped frame structures.

30. A method as defined in claim 29, further comprising:
securing the commonly connected and vertically aligned intersection locations of both X-shaped frame structures to the earth surface.

31. A method defined by claim 22, further comprising:
intersecting the two beams of each X-shaped frame structure at approximately 90 degrees with respect to one another.

32. A method as defined in claim 22, further comprising:
connecting the two X-shaped frame structures to intersect one another at an angle in a horizontal plane parallel to the earth surface;
extending each of the two X-shaped frame structures substantially vertically with respect to the earth surface; and
bracing each one X-shaped frame structure by legs of each other X-shaped frame structure which extend downward from the intersection location of each other X-shaped frame structure on opposite sides of the one X-shaped frame structure.

33. A method defined by claim 32, further comprising:
securing the tetrapod to the earth surface with an anchor which connects to each X-shaped frame structure at its intersection location.

34. A method defined by claim 33, further comprising:
commonly connecting a single anchor to the intersection locations of both X-shaped frame structures of the tetrapod to secure the tetrapod to the earth.

35. A method as defined in claim 33, further comprising:
securing the tetrapod to the earth surface by driving an anchor spike into the earth surface and commonly connecting the anchor spike to the intersection locations of both X-shaped frame structures.

36. A method as defined in claim 35, further comprising:
connecting the anchor spike to the intersection locations of both X-shaped frame structures by extending the anchor spike through an anchor bracket connected to the intersection location of each X-shaped frame structure.

37. A method as defined in claim 22, further comprising:
disassembling the tetrapod after its use to control the deposition, accumulation and retention of windblown particles by disconnecting the two X-shaped frame structures from one another.

38. A method as defined in claim 37, further comprising:
storing the two disconnected X-shaped frame structures in the manner of two-dimensional objects until the X-shaped frame structures are again reconnected as the tetrapod; and
using the tetrapod formed by reconnecting X-shaped frame structures after storage to control the deposition, accumulation and retention of windblown particles.

39. A method of assembling a multi-pod windblown particle control device which controls deposition, accumulation and retention of particles carried by blowing wind, comprising:
forming two X-shaped frame structures;
forming each X-shaped frame structure by intersecting two elongated beams at an intersection location, the portions of the beams extending outward from the intersection location forming legs of each X-shaped frame structure;
connecting the X-shaped frame structures together to form a tetrapod;
orienting the legs of the X-shaped frame structures of the tetrapod to extend outward in three dimensions from the intersection location.

40. A method as defined in claim 39, further comprising:
commonly connecting the plurality of beams at the intersection location.

41. A method as defined in claim 39, further comprising:
contacting outer ends of at least some of the legs with a surface of the earth;
elevating the intersection locations above the earth surface; and
securing the intersection locations to the earth surface.

42. A method defined by claim 41, further comprising:
securing the intersection locations to the earth surface by connecting an anchor spike to the intersection locations and driving the anchor spike into the earth.

43. A method as defined in claim 39, further comprising:
connecting the two X-shaped frame structures to intersect one another at an angle within a horizontal plane parallel to the earth surface.

44. A method as defined in claim 39, further comprising:
connecting the two X-shaped frame structures by placing an upper X-shaped frame structure on top of a lower X-shaped frame structure with notches between the legs at the intersection locations of each X-shaped frame structure interfitting with one another.

45. A method as defined in claim 44, further comprising:
connecting the two X-shaped frame structures to intersect one another approximately perpendicularly in a horizontal plane parallel to the earth surface.

46. A method as defined in claim 44, further comprising:
offsetting the intersection location in each X-shaped frame structure to create two relatively shorter legs and two relatively longer legs of each X-shaped frame structure; and
vertically aligning the offset intersection locations of the connected X-shaped frame structures.

47. A method as defined in claim 46, further comprising:
contacting ends of the two shorter legs of one X-shaped frame structure with a surface of the earth; and
contacting ends of the two longer legs of the other X-shaped frame structure with the earth surface.

48. A method as defined in claim 46, further comprising:
securing the vertically aligned intersection locations of both X-shaped frame structures to a surface of the earth.

49. A method defined by claim 48, further comprising:
commonly connecting a single anchor to the intersection locations of both X-shaped frame structures; and
inserting the single anchor into the earth.

50. A method as defined in claim 49, further comprising:
driving an anchor spike into the earth; and
connecting the anchor spike to the commonly connected intersection locations of both X-shaped frame structures.

51. A multi-pod windblown particle control device for controlling deposition, accumulation and retention of particles from blowing wind on a surface of the earth, comprising:
a first frame structure comprising elongated beams that cross and attach to one another at an intersection location, the elongated beams each having opposite ends;
a second frame structure of substantially the same configuration as the first frame structure, the first and second frame structures connected together with at least one end of a beam of each frame structure oriented to contact the earth surface;
a first anchor bracket attached to the intersection location of the first frame structure; and
a second anchor bracket attached to the intersection location of the second frame structure, and wherein:
the first and second anchor brackets are positioned to receive an anchor spike with the anchor spike driven into the earth surface for connecting the frame structures to the earth surface.

52. A multi-pod particle control device as defined in claim 51, wherein:
each frame structure is substantially two-dimensional; and
the first and second frame structures intersect one another in a horizontal plane when connected together to establish three-dimensional characteristics of the control device.

53. A multi-pod particle control device as defined in claim 51, wherein:
the first and second frame structures are inverted with respect to one another when connected together.

54. A multi-pod particle control device defined by claim 51, wherein:
the intersection location of the two beams on each frame structure is closer to one end of the beams than to other end of the beams.

55. A multi-pod particle control device defined by claim 51, wherein the first and second frame structures are each formed by two elongated beams which cross one another at the intersection location and thereby form X-shaped frame structures.

56. A multi-pod particle control device defined by claim 51, further comprising:
an anchor spike attached to the first and second anchor brackets of the first and second frame structures for connecting the frame structures to the earth surface.

57. A multi-pod particle control device defined by claim 51, wherein:
the first and second anchor brackets are connected to the first and second frame structures to establish alignment for receiving the anchor spike when the frame structures are connected together.

* * * * *